US008132884B2

(12) United States Patent
Brewington et al.

(10) Patent No.: US 8,132,884 B2
(45) Date of Patent: Mar. 13, 2012

(54) DUAL MODE PRINTER WRITE HEADS

(75) Inventors: Grace T. Brewington, Fairport, NY (US); Anthony S. Condello, Webster, NY (US); Daniel Martin Bray, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 39 days.

(21) Appl. No.: 12/542,347

(22) Filed: Aug. 17, 2009

(65) Prior Publication Data

US 2011/0037802 A1 Feb. 17, 2011

(51) Int. Cl.
*B41J 29/38* (2006.01)

(52) U.S. Cl. ..... 347/16

(58) Field of Classification Search ..... None
See application file for complete search history.

(56) References Cited

U.S. PATENT DOCUMENTS

| | | | | |
|---|---|---|---|---|
| 5,517,228 | A * | 5/1996 | Obu et al. | 347/171 |
| 7,564,030 | B2 * | 7/2009 | Shrader et al. | 250/316.1 |
| 2005/0141906 | A1 * | 6/2005 | Murakami | 399/45 |
| 2008/0055379 | A1 * | 3/2008 | Ishikawa et al. | 347/102 |
| 2008/0252690 | A1 | 10/2008 | Van Brocklin et al. | |
| 2009/0034997 | A1 | 2/2009 | Edwards et al. | |

FOREIGN PATENT DOCUMENTS

| | | | |
|---|---|---|---|
| EP | 2228221 | | 9/2010 |
| JP | 2001334649 | A * | 12/2001 |

OTHER PUBLICATIONS

European Patent Office, European Search Report, European Application No. 10172509.1, Oct. 26, 2010, 7 Pages.

* cited by examiner

*Primary Examiner* — Stephen Meier
*Assistant Examiner* — Alexander C Witkowski
(74) *Attorney, Agent, or Firm* — MH2 Technology Law Group LLP

(57) ABSTRACT

A dual mode imaging device includes an input for supplying a recording medium to the printer. The recording medium can be erasable media and/or a non-erasable media. A carriage assembly within the imaging device includes guide rails, the carriage assembly reciprocal along the guide rails and parallel to an imaging surface of the recording medium. The carriage assembly includes an ink jet print head for imaging a non-erasable media in a first print mode and a write head having a UV imaging light source for imaging erasable media in a second print mode. The device further includes a heater provided on the carriage assembly for selectively heating the erasable media to one of an erase temperature and a UV imaging temperature. The heater can be proximate to or incorporated with the UV write head.

11 Claims, 3 Drawing Sheets

DUAL MODE PRINTER WRITE HEADS

FIELD OF THE INVENTION

This invention relates generally to imaging and, more particularly, to imaging both erasable media and non-erasable media in an imaging system in which an erasable media imaging device is integrated with an ink jet imaging device, both imaging devices utilizing the same traverse in the imaging system.

BACKGROUND OF THE INVENTION

Paper documents are often promptly discarded after being read. Although paper is relatively inexpensive, the quantity of discarded paper documents is enormous and the disposal of these discarded paper documents raises significant cost and environmental issues. It would, therefore, be desirable for paper documents to be reusable, to minimize both cost and environmental issues.

Erasable media is that which can be reused many times to transiently store images, the images being written on and erasable from the erasable media. For example, photochromic paper employs photochromic materials to provide an imageable surface. Typically, photochromic materials can undergo reversible or irreversible photoinduced color changes in the photochromic containing layer. In addition, the reversible photoinduced color changes enable imaging and erasure of photochromic paper in sequence on the same paper. For example, a light source of a certain wavelength can be used for imaging erasable media, while heat can be used for inducing erasure of imaged erasable media. An inkless erasable imaging formulation is the subject of U.S. patent application Ser. No. 12/206,136 filed Sep. 8, 2008 and titled "Inkless Reimageable Printing Paper and Method" which is commonly assigned with the present application to Xerox Corp., and is incorporated in its entirety herein by reference.

Because imaging of erasable media has unique requirements, it has previously required dedicated equipment. In particular, a UV source can be required to image the erasable media, and heat can be required to erase an imaged erasable media. In addition, specific temperature parameters are required for each of the imaging and erasing of erasable media. While traditional imaging devices are suitable for performing conventional imaging of non-erasable media, their architecture can be insufficient for handling erasable media alone or in combination with non-erasable media.

Thus, there is a need to overcome these and other problems of the prior art and to provide a dual mode imaging device in which both erasable media and non-erasable paper can be selectively imaged. Even further, the dual mode imaging device should be capable of interchangeably sharing imaging components.

SUMMARY OF THE INVENTION

According to various embodiments, the present teachings include a dual mode imaging device. The dual mode imaging device includes an input for supplying a recording medium to the imaging device, and a carriage assembly, reciprocal along guide rails and parallel to an imaging surface of a recording medium. The carriage assembly includes an ink jet print head for imaging a non-erasable medium in a first print mode and a write head comprising an imaging light source for imaging an erasable medium in a second print mode.

According to various embodiments, the present teachings also include a method for dual mode imaging. The method includes supplying a recording medium to an imaging device, the imaging device comprising a carriage assembly, reciprocal along guide rails and parallel to an imaging surface of a recording medium. The carriage assembly includes an ink jet print head for imaging a non-erasable medium in a first print mode and a write head comprising an imaging light source for imaging an erasable medium in a second print mode. The method further includes determining a type of recording medium from one of the non-erasable medium and erasable medium and imaging the recording medium from one of the ink jet print head and write head on the carriage assembly according to the determined type of medium.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

It should be noted that some details of the figures have been simplified and are drawn to facilitate understanding of the inventive embodiments rather than to maintain strict structural accuracy, detail, and scale.

DESCRIPTION OF THE EMBODIMENTS

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

As used herein, the term "erasable media" refers to transient material that has the appearance and feel of traditional paper, including cardstock and other weights of paper. Erasable media can be selectively imaged and erased.

As used herein, imaged erasable media refers to erasable media having a visible image thereon, the image a result of, for example, ultraviolet (UV) imaging of the erasable media.

As used herein, non-imaged erasable media refers to erasable media which has not been previously imaged, or erasable media having an image erased therefrom and available for UV imaging. An exemplary erasable medium is described in connection with FIG. 1 below.

As used herein, the term "non-erasable" refers to traditional media of the type used in any conventional imaging such as ink jet, xerography, or liquid ink electrophotography, as known in the art. An example of a non-erasable traditional medium can be conventional paper.

Figure 1:
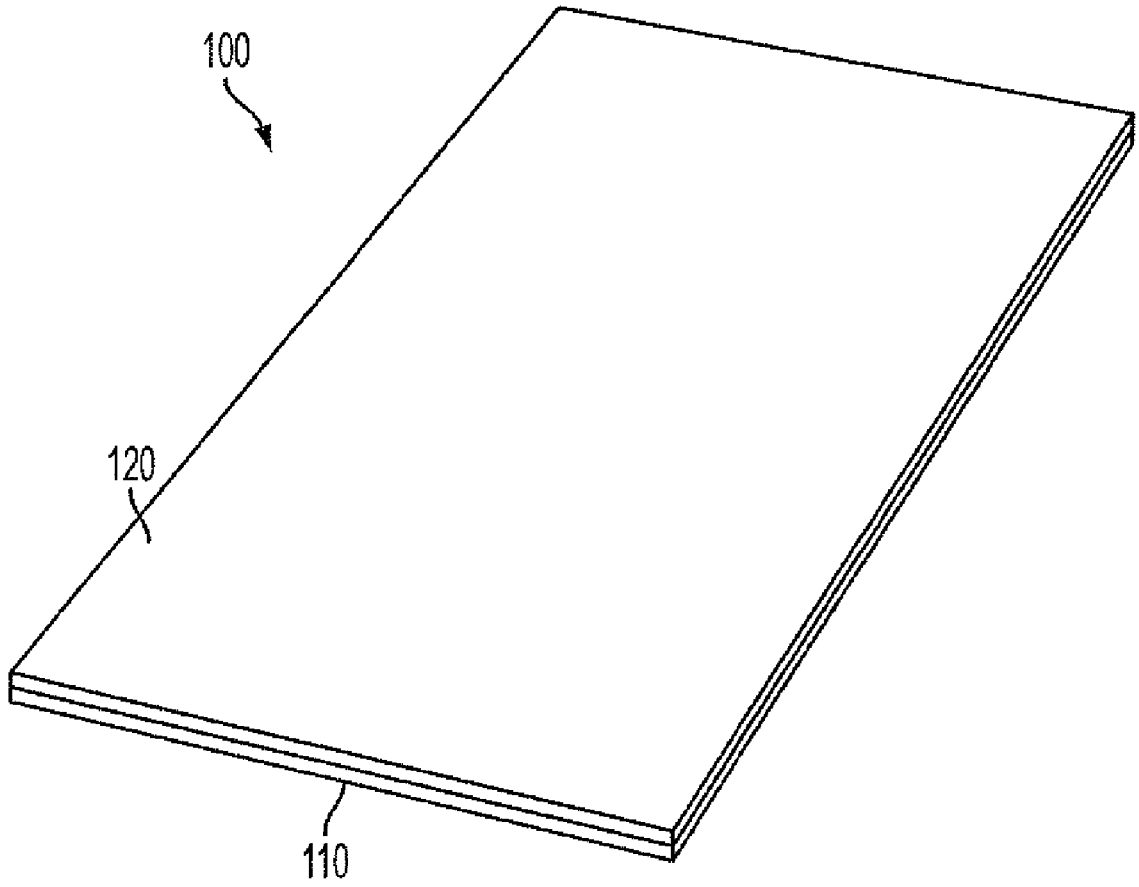
FIG. 1 is a perspective depiction of an erasable media having a photochromic coating which allows for writing an image in the coating on the media and for erasing an image from the coating.

FIG. 1 depicts an exemplary erasable medium 100 in accordance with the present teachings. It should be readily apparent to one of ordinary skill in the art that the erasable medium 100 depicted in FIG. 1 represents a generalized schematic illustration and that other layers can be added or existing layers can be removed or modified.

As shown in FIG. 1, the erasable medium 100 can include a substrate 110 and a photochromic material 120 incorporated into or on the substrate 110. The photochromic material 120 can provide a reversible writing (i.e. erasable) image-forming component on the substrate 110.

The substrate 110 can include, for example, any suitable material such as paper, wood, plastics, fabrics, textile products, polymeric films, inorganic substrates such as metals, and the like. The paper can include, for example, plain papers such as XEROX® 4024 papers, ruled notebook paper, bond paper, and silica coated papers such as Sharp Company silica coated paper, Jujo paper, and the like. The substrate 110, such as a sheet of paper, can have a blank appearance.

In various embodiments, the substrate 110 can be made of a flexible material and can be transparent or opaque. The substrate 110 can be a single layer or multi-layer where each layer is the same or different material and can have a thickness, for example, ranging from about 0.05 mm to about 5 mm.

The photochromic material 120 can be impregnated, embedded or coated to the substrate 110, for example, a porous substrate such as paper. In various embodiments, the photochromic material 120 can be applied uniformly to the substrate 110 and/or fused or otherwise permanently affixed thereto.

Portion(s) of photochromic material of an imaged erasable medium 100 can be erased. In order to produce the transition from a visible image to an erased medium, heat can be applied to the erasable medium 100 at a temperature suitable for effecting the erasure. For example, at a temperature between about 80° C. to about 200° C., the erasable medium 100 can be completely erased. In order to re-image the erased (or image an original) erasable medium 100, the erasable medium 100 can be heated to a temperature of between about 55° C. to about 80° C. before writing using, for example, UV exposure.

It will be appreciated that other types of erasable media, other than photochromic paper, can be used in connection with the exemplary embodiments herein. Such types of erasable media are intended to be included within the scope of the disclosure.

While the temperatures for processing erasable media can be achieved and maintained in a single mode device for imaging and erasing erasable media, the following describes an exemplary incorporation of a dual mode imaging system capable of processing erasable media as well as producing traditional (non-erasable) prints and copies. The traditional prints and copies can be produced by ink jet. The ink jet can include aqueous ink jet, solid ink jet and gel ink jet. By a unique integration as described in the following, an erasable media imaging device can share a traverse with an ink jet print head. In addition, the integrated imaging devices can include a heater for both erasing and imaging erasable media and for heating erasable media to a temperature suitable for UV imaging thereof.

Figure 2A:
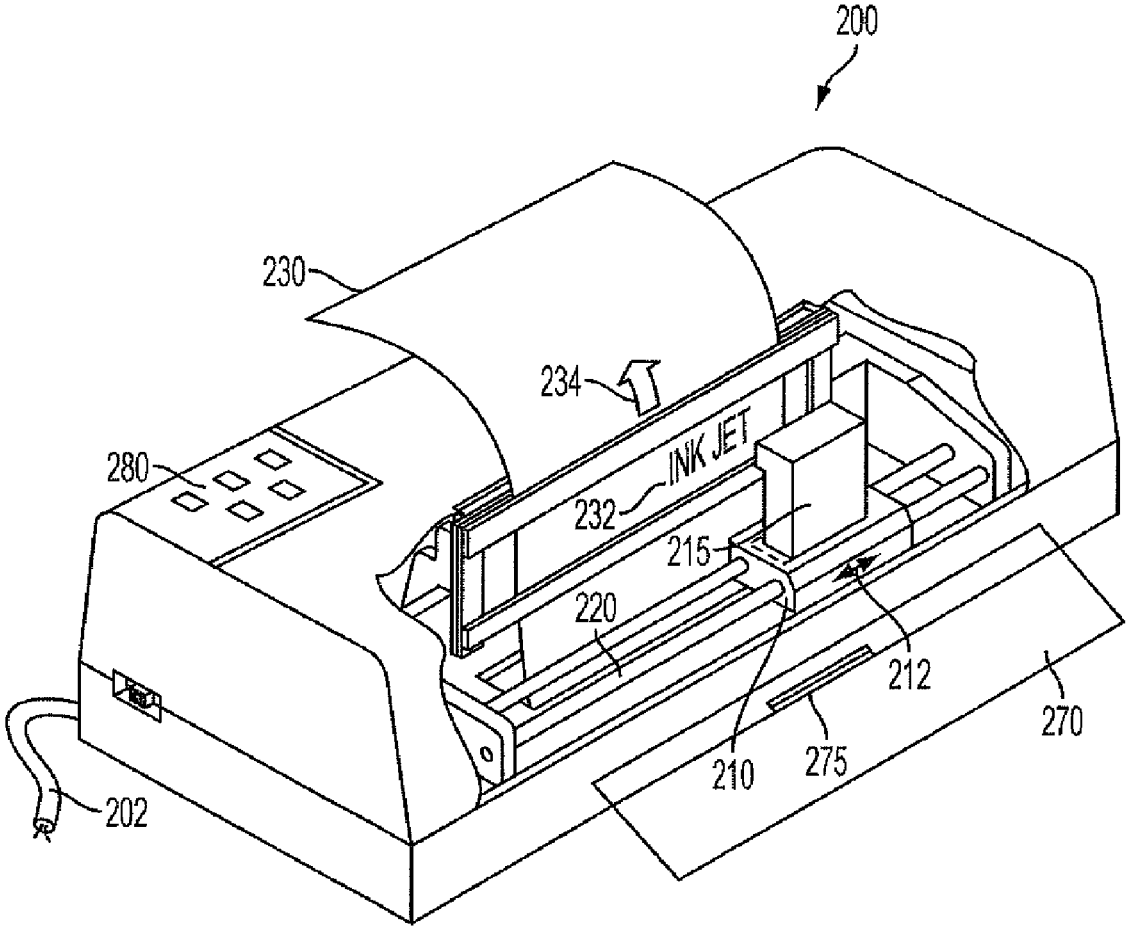
FIG. 2A depicts an imaging device including dual mode imaging write heads in accordance with the present teachings.
Figure 2B:
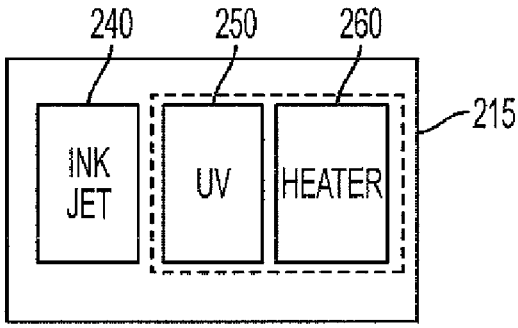
FIG. 2B is a schematic diagram depicting the dual mode imaging device write heads alone in accordance with the present teachings.

FIG. 2A depicts an exemplary printer 200 and FIG. 2B depicts detail of the exemplary printer of FIG. 2A in accordance with the present teachings. It should be readily apparent to one of ordinary skill in the art that the printer 200 depicted in FIGS. 2A and 2B represent a generalized schematic illustration and that other components can be added or existing components can be removed or modified.

As shown in FIG. 2A, the printer 200 can include a carriage assembly 210 supporting a dual mode write head assembly 215, the carriage assembly slidable on guide rails 220. The carriage assembly 210 can reciprocate back and forth in the direction of arrow 212 in order to image a recording medium 230. The recording medium 230 can include one of the erasable medium or non-erasable paper.

In certain embodiments, and as depicted in further detail in FIG. 2B, the carriage assembly 210 can include an ink jet printhead 240 and an erasable media write head 250. In certain embodiments, the carriage assembly 210 can further support a heater component 260. With each of the ink jet printhead 240, write head 250 and heater component 260 mounted on the same carriage assembly 210, each of these devices can utilize the same traverse over guide rails 220. In an ink jet write mode, the ink jet printhead 240 can be used to image the non-erasable paper type recording medium 230. When an erasable medium is utilized for the recording medium, the write head 250 can be used to image the erasable medium.

The ink jet printhead 240 can include one or more ink supply cartridges releasably mounted therein. The ink jet printhead 240 can utilize orifices, nozzles, etc. to image the non-erasable paper type recording medium 230 in response to digital data signals received by a printer controller (not shown), via a power/communication source 202, as known in the art. Thus, the ink jet printhead 240 can print a swath of information 232 on the recording medium 230 while the recording medium is held stationary and the carriage assembly 210 traverses the recording medium 230 along the guide rails 220. The recording medium 230 can be stepped a distance equal the printed swath in the direction indicated by arrow 234, as soon as the carriage assembly 210 completes its traverse in one direction and prior to the carriage assembly 210 reversing its reciprocating direction for travel in an opposite direction. As the carriage assembly 210 with the ink jet printhead 240 moves in the opposite direction, another swath of information can be printed. It will be appreciated that the ink jet printhead 240 can include those configurations in which regular prints are produced by ink jet, including aqueous ink jet, solid ink jet, or gel ink jet.

In certain embodiments, the erasable media write head 250 can include an imaging light source (imaging bar, not individually depicted) such as a UV light source. The UV write head 250 can include one or more LED's. With currently known photochromic erasable media, 365 nm LED's can be used for writing. The UV source can be provided at an intensity and duration sufficient to produce an image, which will depend on the characteristics of the photochromic coating used in the erasable media type recording medium 230. For example, the wavelength of the imaging source can be in the range of about 10 to about 450 nanometers. The imaging light source can be patterned and imaged directly on the erasable media 230 to print a pattern on the erasable media. Light shielding can be employed to ensure that stray light does not image erasable media near the UV light source.

Thus, the write head 250 can print the swath of information 232, via UV imaging, on the erasable media type recording medium 230 while the recording medium is held stationary and the carriage assembly 210 traverses the recording medium 230 along the guide rails 220. The recording medium 230 can be stepped a distance equal the printed swath in the direction indicated by arrow 234, as soon as the carriage assembly 210 completes its traverse in one direction and prior to the carriage assembly 210 reversing its reciprocating direction for travel in an opposite direction. As the carriage assembly 210 with the write head 250 moves in the opposite direction, another swath of information can be printed.

The erasable media write head 250 can UV image the erasable media 230 once the erasable media reaches a predetermined temperature. An exemplary UV imaging temperature of an erasable media 230 is from about 55° C. to about 80° C. A further exemplary UV imaging temperature of the erasable media is from about 60° C. to about 70° C. A UV imaging temperature can be about 65° C. Other UV imaging temperatures can be set according to a type of erasable media and such imaging temperatures are intended to be included within the scope of the invention. In order to attain a suitable imaging temperature in an erasable media 230, the heater component 260 can be activated. In certain embodiments, heater 260 can be incorporated into the write head 250.

It will also be appreciated that the heater 260 can be separately supported by the carriage assembly 210 proximate the ink jet printhead 240 and the write head 250. In certain embodiments, the heater 260 can be incorporated into the housing of the printer 200 as a bar, block, etc. positioned in front of or behind the imaging medium 230. For example, the heater 260 can be incorporated into a guide rail 220 closest to the imaging medium 230. In another example, the heater 260 can be incorporated into an internal mounting block (not shown) positioned such that the imaging medium 230 is between the heater 260 and the carriage assembly 210.

The heater component 260 can be further utilized to erase an imaged erasable media 230. In certain embodiments, imaged erasable media can be fed through the printer 200 with the heater component 260 activated to a temperature suitable for erasing the imaged erasable media. An exemplary erase temperature can be in a range of about 80° C. to about 200° C. A further exemplary erase temperature can be in a range of about 90° C. to about 100° C. Yet a further exemplary erase temperature can be about 160° C. Other erase temperatures can be set according to a type of erasable media and such temperatures are intended to be included within the scope of the invention.

The erased erasable media can be ejected to an exterior of the printer 200 for cooling. In certain embodiments, the erased erasable media can be cooled within the printer 200 by cooling fans or the like (not shown).

In certain embodiments, the printer 200 can include one or more input trays 270. The input trays 270 can include one or more input trays for each of an erasable media, non-erasable mediums, and mixed erasable and non-erasable mediums. It will be appreciated that the erasable media can be an erasable medium in the original, in which the erasable medium has not been previously imaged, an erased erasable medium, or an imaged erasable medium, as yet not erased.

In certain embodiments, a sensor 275 can be provided to detect a type of medium entering the printer 200. The sensor 275 can be proximate each input tray 270, incorporated in the input tray 270, mounted in connection with the carriage assembly 210, or other interior of the printer housing. For example, the sensor 275 can detect erasable media and thereby the control system directs a printing operation via the write head 250 on the carriage assembly 210. In the event erasable media is detected, the heater component 260 can also be activated in order to heat the erasable media to a temperature suitable for UV imaging by the write head 250. As previously described, the heater can be incorporated in or distinct from the write head 250.

Likewise, the sensor 275 can detect a non-erasable medium and thereby the control system directs a printing operation via the ink jet printhead 240 mounted on the carriage assembly 210.

In certain embodiments, the sensor 275 can detect an imaged erasable medium. In the event an imaged erasable medium is detected, the heater component 260 can be activated in order to heat the imaged erasable medium to a temperature suitable for erasing the image thereon. Subsequent to cooling, typically by ejection from the printer 200, the erased erasable medium can be re-used for imaging by the write head 250.

In certain embodiments, a user interface 280 can be provided in the printer housing 200. The user interface 280 can include control components, responsive to user input, for directing the functions of the dual mode printer write heads 240, 250. In certain embodiments, the printer 200 can be configured through the user interface 280 to start up in a single printing mode (erasable media mode or regular printing mode for printing non-erasable mediums) or in dual printing mode.

Alternatively, the user interface 280 can prompt the operator to check for the proper media at the job start and at the transition to the other printing mode. The user interface 280 can further be responsive to the sensor 275 and control system and the sensor 275 and control system can be responsive to input at the user interface 280.

It will be appreciated that while an ink jet printer 200 is disclosed as incorporating the dual mode printer write heads 215, the disclosure can be similarly applied to other printers based on the disclosure herein. Such modifications are intended to be included within the scope of this disclosure.

Figure 3:
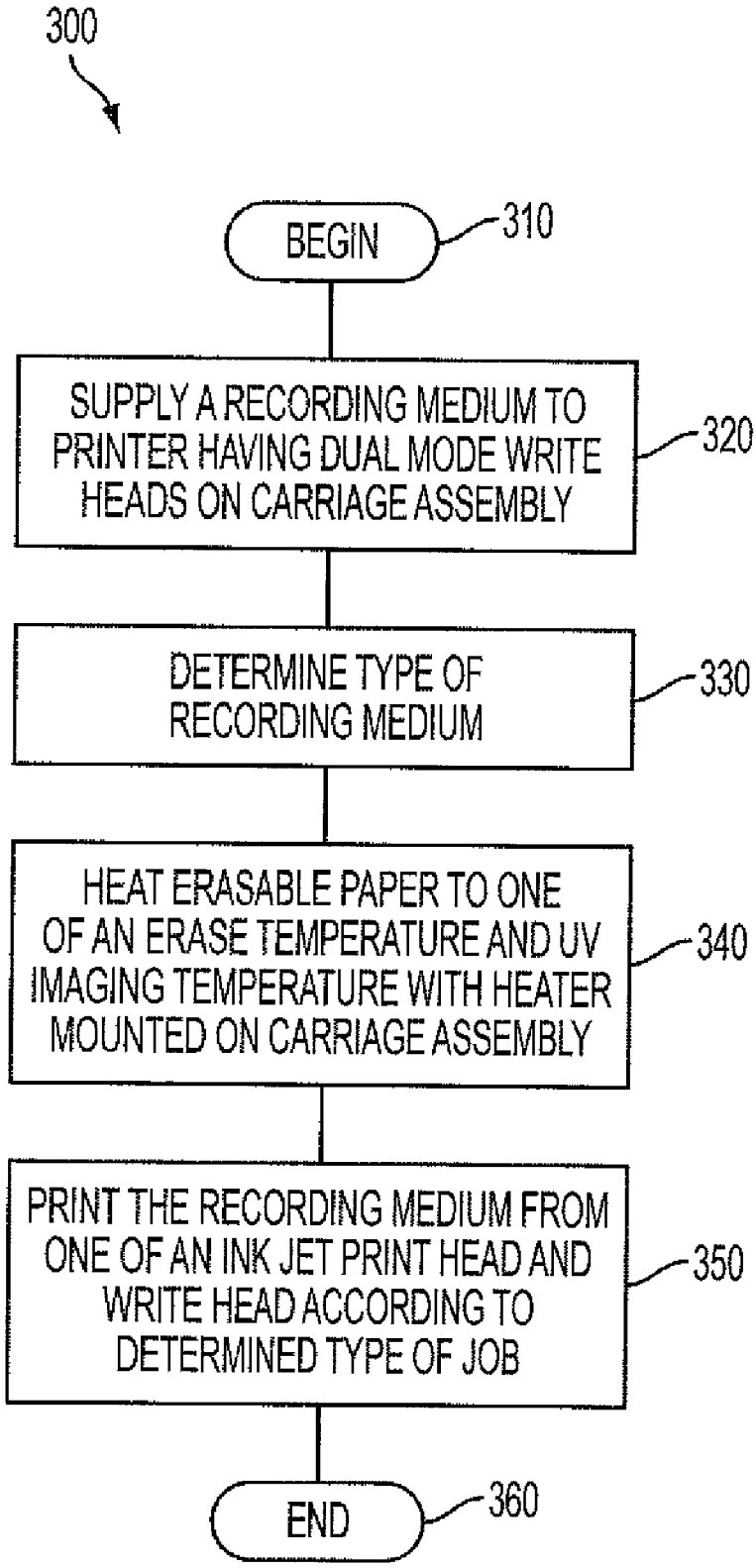
FIG. 3 depicts an exemplary method for printing with the dual mode write heads in accordance with the present teachings.

FIG. 3 discloses a method 300 of printing with the dual mode printer write head in accordance with the present teachings. It should be readily apparent to one of ordinary skill in the art that the method 300 represents a generalized schematic illustration and that other components can be added or existing components can be removed or modified.

The method can begin at 310.

At 320, a recording medium can be supplied to a printer. The printer can include a carriage assembly, reciprocal along guide rails and parallel to an imaging surface of a recording medium. The carriage assembly includes dual mode printer write heads. For example, the carriage assembly can include an ink jet print head for imaging non-erasable media in a first print mode and a write head comprising an imaging light source for imaging erasable media in a second print mode.

At 330, a type of recording medium is determined from one of a non-erasable media paper and erasable media. Determining can be by a sensor. In certain embodiments, the sensor can be proximate a media input.

At 340, an erasable medium can be selectively heated to one of an erase temperature and a UV imaging temperature with a heater mounted on the carriage assembly.

At 350, printing can occur on the recording medium from one of the ink jet print head and write head on the carriage assembly according to the determined type of medium. In certain embodiments, the printing using the write head can include providing a UV imaging light source in the write head. In certain embodiments, the write head can further include the heater for selectively heating the erasable medium.

The printer can further be configured via a user interface. Likewise, the user interface can reflect a type of media detected and present certain processing selections based upon the detected media type. For example, when an erasable media job is selected at the user interface, the control system can direct the system through certain processing selections. One step might be to confirm that the media is erasable or confirm that the media is of the non-erasable type.

In certain embodiments, the dual mode imaging system can produce jobs that select only erasable media, jobs that select only non-erasable media, and jobs that select an erasable medium for at least one of the sheets and a non-erasable medium for at least one of the sheets. Job selection can be executed at the user interface. Further, job selection can be executed at the user's personal computer print dialog box through the properties link to the print driver controls. Alternatively the user interface can prompt the operator to check for the proper media at the job start and at transition to another printing mode. The user interface can further be responsive to the sensor and the sensor can be responsive to input at the user interface.

At 360, the method can end, but one of ordinary skill in the art will understand that the method can return to any previous point and repeat prior to ending.

It will be appreciated that the exemplary embodiments can be incorporated into an imaging system such as that described in connection with U.S. patent application Ser. No. 12/404,517 filed Mar. 16, 2009 and titled "Infrared Heat Source Tied to Image Scanner for Transitional Document Erasing" which is commonly assigned with the present application to Xerox Corp. and is incorporated herein by reference, in its entirety. For example, a scan head including a UV imaging bar can incorporate an ink jet printhead. As such, the ink jet printhead can utilize the same traverse as that of the UV imaging bar in order to selectively image an imaging medium with either the ink jet printhead or the UV imaging device.

The embodiments of the present teachings can be controlled by a microprocessor contained within the device, or it can be controlled by a separate computer or microprocessor which is part of a larger network of devices, such as a plurality of office devices, printing devices, etc.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function.

Furthermore, to the extent that the terms "including," "includes," "having," "has," "with," or variants thereof are used in either the detailed description and the claims, such terms are intended to be inclusive in a manner similar to the term "comprising" The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dual mode imaging device comprising:

an input configured to supply an erasable media, a non-erasable media, or both an erasable and a non-erasable media to the imaging device;

a sensor configured to distinguish between the non-erasable and the erasable recording medium; and a carriage assembly, reciprocal along guide rails and parallel to an imaging surface of the recording medium, the carriage assembly comprising, an ink jet print head configured to image non-erasable media in a first print mode, a write head comprising an imaging light source configured to image erasable media in a second print mode, and a heater configured to selectively heat the erasable media to one of an erase temperature and a UV imaging temperature.

2. The device of claim 1, wherein the imaging light source comprises a UV imaging light source.

3. The device of claim 1, the input comprising at least one input tray for supplying one or more of erasable media and a non-erasable media to the imaging device.

4. The device of claim 1, wherein the sensor is proximate the input.

5. The device of claim 1, further comprising a user interface for configuring the imaging device according to a type of job requirements.

6. The device of claim 1, wherein the ink jet printhead is selected from the group consisting of an aqueous ink jet printhead, a solid ink jet printhead, and a gel ink jet printhead.

7. The device of claim 1, wherein the erasable media comprises photochromic paper.

8. A method for dual mode imaging comprising:

supplying a recording medium to an imaging device, the recording medium comprising one of erasable media and non-erasable media, the imaging device comprising a carriage assembly, reciprocal along guide rails and parallel to an imaging surface of a recording medium, the carriage assembly comprising an ink jet print head for imaging non-erasable media, a write head for imaging erasable media, and a heater configured to selectively heat the erasable media to one of an erase temperature and a UV imaging temperature;

determining a type of recording medium from one of the non-erasable media and erasable media; and selectively imaging the recording medium from one of the ink jet print head in a first mode and write head in a second mode according to the determined type of recording medium.

9. The method of claim 8, wherein selectively imaging from the write head comprises imaging with a UV imaging light source.

10. The method of claim 8, further comprising detecting a type of recording medium input to the printer, wherein the sensor is proximate the input.

11. The method of claim 8, further comprising configuring the printer, via a user interface, according to a type of print job requirements.

* * * * *